US007226322B2

(12) United States Patent
Schuldt

(10) Patent No.: US 7,226,322 B2
(45) Date of Patent: Jun. 5, 2007

(54) CURRENT SUPPLY POINT FOR A POWER AND CONTROL UNIT OF A BATTERY-OPERATED INDUSTRIAL TRUCK

(75) Inventor: Thomas Schuldt, Hamburg (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 0 days.

(21) Appl. No.: 11/373,028

(22) Filed: Mar. 10, 2006

(65) Prior Publication Data

US 2006/0216971 A1 Sep. 28, 2006

(30) Foreign Application Priority Data

Mar. 26, 2005 (DE) ..... 10 2005 013 953

(51) Int. Cl.
*H01R 4/30* (2006.01)

(52) U.S. Cl. ..... 439/801; 439/736; 174/267

(58) Field of Classification Search ..... 439/83, 439/801, 926, 736, 76.1; 174/267
See application file for complete search history.

(56) References Cited

U.S. PATENT DOCUMENTS 3,624,588 A * 11/1971 Farmer ..... 439/83
4,863,389 A * 9/1989 Kobari et al. ..... 439/83
6,142,609 A * 11/2000 Aoki ..... 347/50
6,142,836 A 11/2000 Deckmann et al. ..... 439/801
6,623,282 B2 * 9/2003 Boyd ..... 439/83
7,029,313 B1 * 4/2006 Huang ..... 439/381
7,039,533 B2 * 5/2006 Bertness et al. ..... 702/63

FOREIGN PATENT DOCUMENTS

DE 196 54 384 A1 6/1998
DE 102 15 985 A1 11/2003
DE 102 20 047 A1 11/2003

* cited by examiner

*Primary Examiner*—Tho D. Ta
*Assistant Examiner*—Vanessa Girardi
(74) *Attorney, Agent, or Firm*—Vidas, Arrett & Steinkraus, P.A.

(57) ABSTRACT

A current supply point for a power and control unit of a battery-operated industrial truck wherein the power and control unit has a printed-circuit board inside a casing, the current supply point has a first component connectable to the printed-circuit board and a pin-shaped second component led out of the casing in an insulation which is adapted to be brought into electric contact with the first component, and wherein a portion of the second component that is located outside the casing has means for connection to a conductor, wherein the first component has a first portion connectable to the printed-circuit board, a second portion having a male thread, and a third portion including an annular first contact surface, the second component has an axial bore with a female thread within a first end portion that is adapted to be screwed onto the male thread of the first component so as to cause the first contact surface to abut against an annular second contact surface of the second component.

8 Claims, 3 Drawing Sheets

CURRENT SUPPLY POINT FOR A POWER AND CONTROL UNIT OF A BATTERY-OPERATED INDUSTRIAL TRUCK

CROSS-REFERENCE TO RELATED APPLICATIONS

Not applicable.

STATEMENT REGARDING FEDERALLY SPONSORED RESEARCH

Not applicable.

BACKGROUND OF THE INVENTION

For the supply to a power and control unit of a battery-operated industrial truck, a cable connection is usually provided between a battery and the unit. The cable requires to be connected to the contacts of the battery, on one hand, and those of the power and control unit, on the other. The invention refers to the latter current supply point.

The power and control unit, amongst other things, has a converter or d.c.-to-a.c. inverter for the conversion of the d.c. voltage into an a.c. or three-phase voltage. The electric and electronic components of the power and control unit usually are arranged on at least one printed-circuit board which is disposed in an insulation inside a casing. It has been known already to connect an electrically conducting component, which interacts with a pin-shaped conducting component, to the printed-circuit board by sliding it onto a gudgeon-shaped portion of the first component. The externally located end of the second component is connected to the cable lug of the conductor of the current cable, for example. In the known case, the second component which is formed as a pin bushing works similarly to a snap-fit closure and, thus, transmits the current solely via a circular contact line. The transmissibility for the current is limited, for this reason. Furthermore, the known current supply point is expensive with regard to its manufacture.

DE 196 54 384 A1 has made known a clamp terminal for electrical appliances where a slidable plate, as a connection plate, is connected to a printed-circuit board and a terminal screw is captively retained in a casing top. The connection plate has a threaded extruded hole or a threaded insert is provided to receive the terminal screw. The connection plate may be soldered to the printed-circuit board by the SMD process.

It is the object of the invention to provide a current supply point for a power and control unit of a battery-operated industrial truck that can be manufactured with little effort, can be disposed so as to save space, and allows to transmit high currents.

BRIEF SUMMARY OF THE INVENTION

In the inventive current supply point of claim 1, the first component has a first portion connectable to the printed-circuit board, a second component having a male thread, and a third portion including an annular contact surface. The first component is soldered to the printed-circuit board by the SMD process, for example.

The second component has an axial bore with a female thread within a first end portion. The female thread is adapted to be screwed onto the male thread of the first component. The second component further has an annular second contact surface which gets into engagement with the first contact surface when the two components are screwed onto each other. This establishes a snugly fitting surface-type contact between the two components so that a transmission of high currents is possible.

The other end of the second, pin-shaped component is configured such as to allow a connection to a conductor of a cable, e.g. via a cable lug which is clipped to the second component by means of a attachment screw.

In the inventive current supply point of claim 2, the first component has a cylindrical projection and the second component has a cylindrical bore with the cylindrical projection and cylindrical bore defining a press fit together. This is why the second component requires to be slid and pressed onto the first one with a considerable force, which provides for a surface-type contact between the surfaces touching each other. It is also in this way that a large contact surface is created for a transmission of high currents.

Apart from making it possible to transmit high currents, the inventive current supply point has the further advantage that it can be manufactured very easily and exhibits very small dimensions. As is known spatial dimensions play a very large role for structural parts and components of an industrial truck.

According to an aspect of the invention, the contact surfaces are of a conical shape. According to a further aspect of the invention, the first component is made of a material which is softer than that of the second component. While the second component is being screwed onto the first one a certain deformation of the second component will occur in the area of the second contact surface if the torque is appropriate so that a snug abutment of the contacting surfaces upon each other is ensured for the purpose of favourable current transmission. This relies on the cognition that it is unnecessary to repeatedly disconnect the current supply point at this point. Repeatedly disconnecting the current supply point will be necessary at the other end if the battery is charged via a charging cable.

The invention will be described in more detail below with reference to an embodiment shown in the drawings.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated FIG. 1 very schematically shows a side view of an inventive current supply point for a power and control unit of a battery-operated industrial truck.

Figure 1:
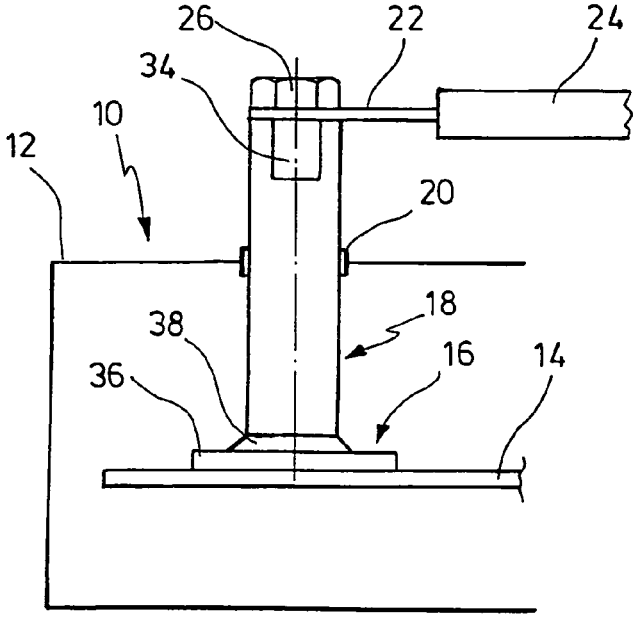

FIG. 1 merely outlines a power and control unit 10 of a battery-operated industrial truck. The unit includes an insulating casing 12 in which at least one printed-circuit board 14 is disposed in an insulation. A first component 16 is soldered onto the printed-circuit board 14 by the SMD process. A second component 18 is screwed to the first component 16. Reference to this fact will be made later below.

The pin-shaped component 18 is led out through an opening in the cover portion of the casing 12 that has a seal 20. A cable lug 22 of a cable 24, which is passed to a battery (not shown) of the industrial truck (not shown) is clipped to the upper end of the component 18 by means of a attachment screw 26.

Figure 3:
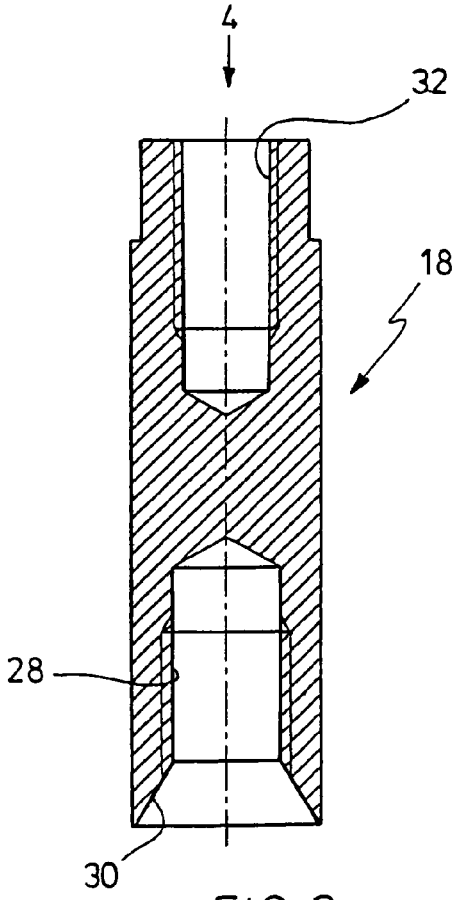
FIG. 3 shows a section through the representation of FIG. 2 taken along the line 3—3.
Figure 4:
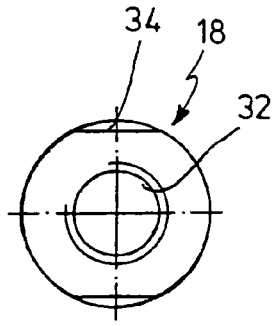
FIG. 4 shows a plan view of the component of FIG. 1 in the direction of the arrow 4.

FIG. 3 allows to recognize that the pin-shaped or cylindrically shaped component 18 has its lower end provided with a first axial threaded bore 28 which is flared towards its free end or bottom so as to form a conical surface 30. Another threaded bore 32 is formed in the upper end region. At its upper end, the component 18 further has opposite flattened areas 34 which define so-called key engagement surfaces. The component 16 of FIG. 1 has a circular flange-like portion 36 which is joined by a conical portion 38 towards the top. A cylindrical portion 40 which joins it towards the top has a male thread 41. The component 16 finally exhibits an axial through bore 42.

The component 16 is soldered to the printed-circuit board 14 by means of a SMD process, for example. The component 18 which is made of aluminium, for example, screws its lower end onto the component 16 with the thread 42 of the component 16 interacting with the female thread of the threaded bore 28. At this stage, the conical contact surface 30 comes to bear against the outer surface of the conical portion 38 of the component 16 which is made of a somewhat harder material, e.g. silver-plated brass. This way creates a continuous annular contact surface. A key which engages the key engagement surfaces 34 helps in screwing the component 18 onto the component 16 at a major force so that this creates a relatively high superficial pressure between the contacting surfaces.

The attachment screw 26 is screwed into the upper threaded bore 32 by its shank (not recognizable). During this action, the lower side of the head of the attachment screw 26 is forced against the upper side of the cable lug and the latter one, in turn, is forced against the upper end of the pin-shaped component 18 in order to establish the desired electric contact.

Figure 2:
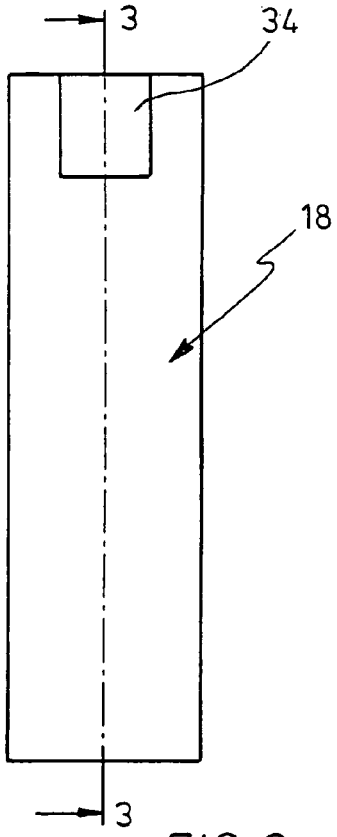
FIG. 2 shows a side view of the pin-shaped component in the current supply point of FIG. 1.
Figure 5:
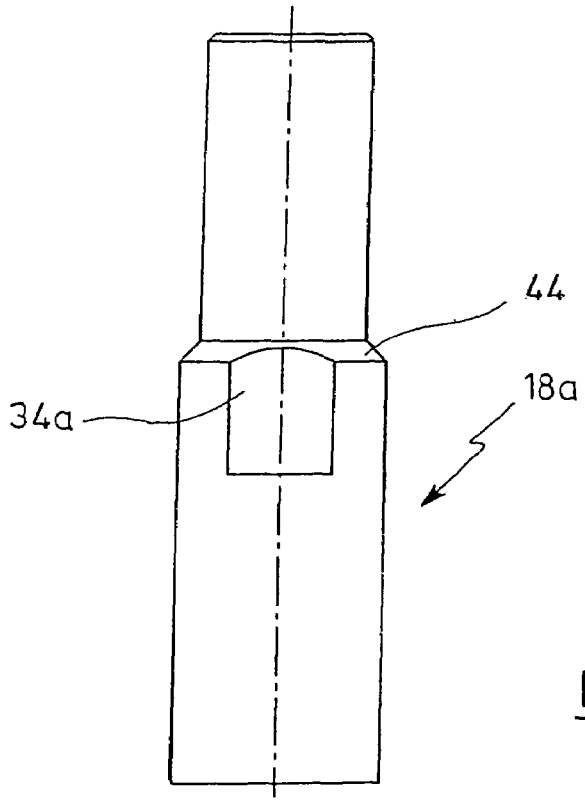
FIG. 5 shows a side view of an alternative pin-shaped component.
Figure 6:
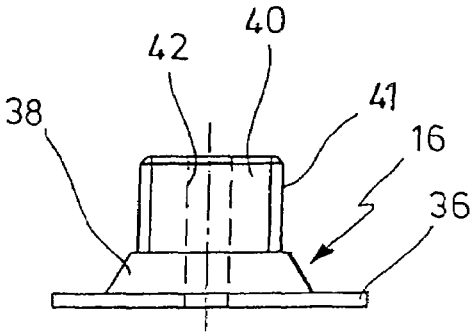
FIG. 6 shows a side view of a further component in the current supply point of FIG. 1.
Figure 7:
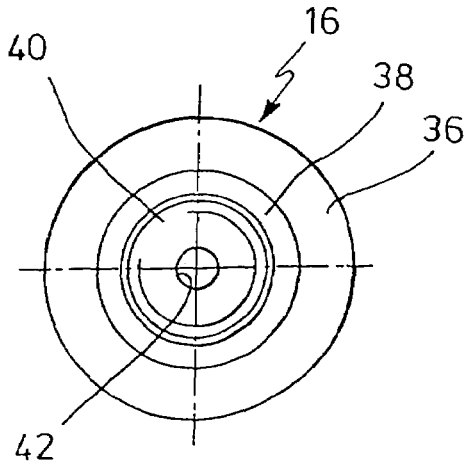
FIG. 7 shows a plan view of the component of FIG. 6.

FIG. 5 shows an alternative embodiment for the component 18 which is indicated by 18*a* there. The component has a conical shoulder 44 between the ends. Thus, the upper portion of the component 18*a* is given a diameter smaller than that of the lower one. The key engagement surfaces 34*a* are located below the shoulder 44. The inside configuration of the component 18*a* is the same as that of the component 18 of FIGS. 2 and 3.

Figure 8:
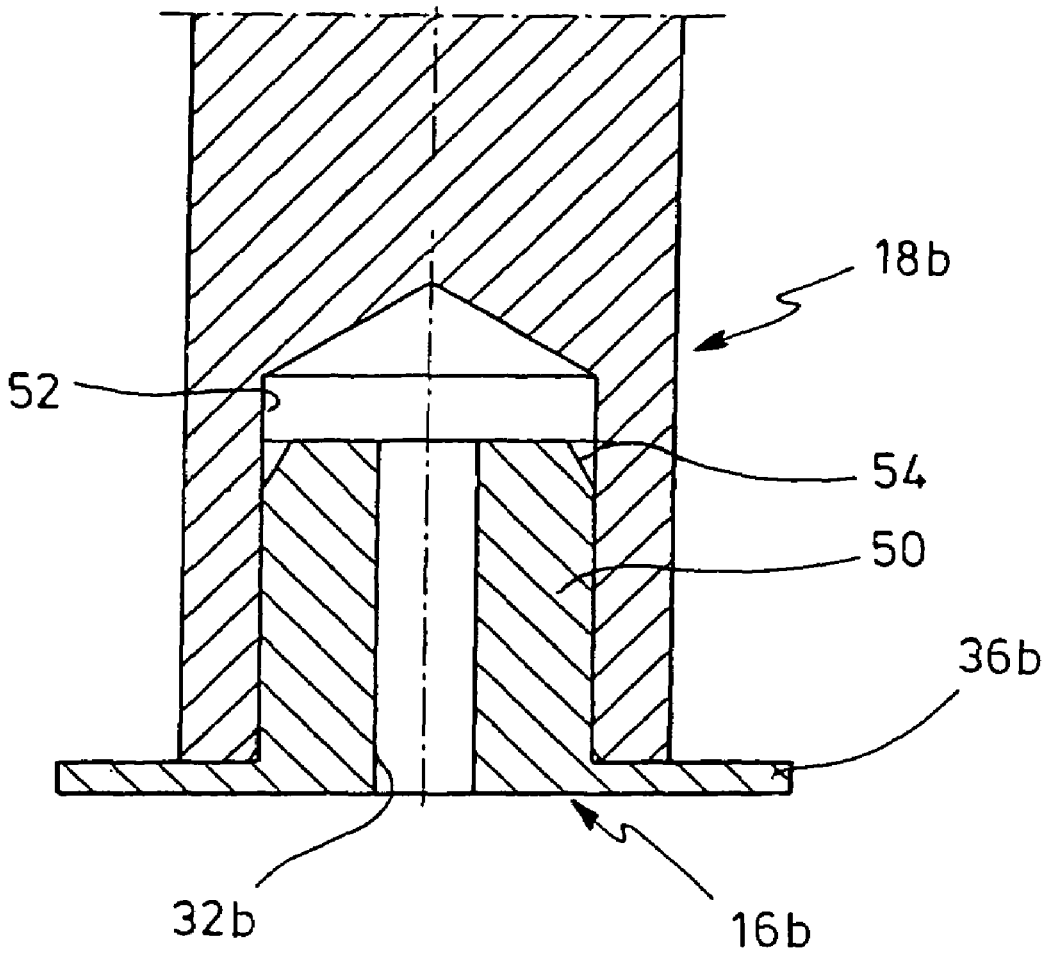
FIG. 8 shows a section through another embodiment of a current supply point of the invention.

In FIG. 8, a first component 16*b* is provided with a flange 36*b* for being soldered to a printed-circuit board, e.g. the printed-circuit board 14 of FIG. 1. The flange 36*b* has integrally formed therein a cylindrical portion 50 which has a predetermined outside diameter. A pin-type second component 18*b* has a blind hole 52 at its lower end. The inside diameter of the hole 52 is slightly smaller than the outside diameter of the cylindrical portion 50. Therefore, the pin-shaped component 18*b* requires to be slid onto the cylindrical portion 50 at a considerable force (a press fit). To facilitate this process, the cylindrical portion 50 is conically chamfered as is shown at 54. This way creates a large cylindrical contact surface for the transmission of high currents to the component 36*b* and, hence, the printed-circuit board, from the component 18*b*. When the free end of the pin-shaped component 18*b* comes to bear against the upper side of the flange 36*b* another possibility of contact will arise here.

Like it has been done in the component 18 already, a axial through bore 32*b* is also provided in the component 18*b*.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A current supply terminal for a power and control unit used in a battery-operated industrial truck wherein the power and control unit has a printed-circuit board inside a casing, the current supply terminal has a first integral component contained within the casing and connectable to the printed-circuit board; and a pin-shaped second integral component having two end portions, a first end portion within the casing and in electrical contact with the first integral component, and a second end portion located outside the casing has means for connection to a conductor; wherein the first integral component comprises;

a first portion connectable to the printed-circuit board, a second portion having male threads, and a third annular, conical or cylindrical portion including a first contact surface, wherein the first end portion of the second integral pin shaped component has a female threaded axial bore and an internal contact surface; wherein the axial bore screws onto the male threads of the first integral component causing the first contact surface to abut against the internal contact surface of the second component.

2. A current supply terminal for a power and control unit used in a battery-operated industrial truck wherein the power and control unit has a printed-circuit board inside a casing, the current supply terminal has a first integral component contained within the casing and connectable to the printed-circuit board; and a pin-shaped second integral component having two end portions, a first end portion within the casing and in contact electrical contact with the first integral component, and a second end portion located outside the casing has means for connection to a conductor characterized by; the first integral component comprises:

a first portion connectable to the printed-circuit board, and a cylindrical second portion; and the first end portion of the second integral component has an axial bore which facilitates a press fit connection with the cylindrical second portion of the first component within the casing.

3. The current supply terminal according to claim 1, characterized in that the portion of the second component that is located outside the casing has attached thereto key engagement surfaces.

4. The current supply terminal according to claim 1, characterized in that the first contact surface is defined by a conical third portion located between the first and second portions and the second component has a complementary cone surface within the end portion of the axial bore.

5. The current supply terminal according to claim 1, characterized in that the component is made of a material which is softer than that of the first component.

6. The current supply terminal according to claim 5, characterized in that the component is made of aluminum and the first component is made of brass, preferably silver-plated brass.

7. The current supply terminal according to claim 1, characterized in that the first component has an axial through bore.

8. The current supply terminal according to claim 1, characterized in that the pin-shaped second component is of a substantially cylindrical shape.

* * * * *